US007778564B2

(12) United States Patent
Sone et al.

(10) Patent No.: US 7,778,564 B2
(45) Date of Patent: Aug. 17, 2010

(54) FIXING DEVICE AND FIXING METHOD OF IMAGE FORMING APPARATUS

(75) Inventors: Toshihiro Sone, Kanagawa-ken (JP); Osamu Takagi, Tokyo (JP); Satoshi Kinouchi, Tokyo (JP); Yoshinori Tsueda, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 149 days.

(21) Appl. No.: 11/684,258

(22) Filed: Mar. 9, 2007

(65) Prior Publication Data

US 2008/0219722 A1 Sep. 11, 2008

(51) Int. Cl.
*G03G 15/20* (2006.01)

(52) U.S. Cl. ..... 399/69; 399/33

(58) Field of Classification Search ..... 399/33, 399/44, 67, 69, 328

See application file for complete search history.

(56) References Cited

U.S. PATENT DOCUMENTS

| | | | | |
|---|---|---|---|---|
| 5,999,768 | A * | 12/1999 | Gillen et al. | 399/92 |
| 6,964,515 | B2 * | 11/2005 | Asakura et al. | 374/133 |
| 2005/0008413 | A1 * | 1/2005 | Takagi et al. | 399/330 |
| 2005/0053390 | A1 * | 3/2005 | Suzuki et al. | 399/69 |

FOREIGN PATENT DOCUMENTS

| | | |
|---|---|---|
| JP | 2001-109316 | 4/2001 |
| JP | 2002-340682 | 11/2002 |
| JP | 2003-004536 | 1/2003 |

OTHER PUBLICATIONS

Eugene A. Avallone, Theodore Baumeister, Ali Sadegh, Lionel Simeon Marks, Marks' Standard Handbook for Mechanical Engineers, 1996, Published by McGraw-Hill Professional, Section 4-63.*

Infrared Filter. Specification page [online]. Optical Coatings Japan, 2005 [retrieved on Nov. 24, 2008]. Retrieved from the Internet: <URL:http://web.archive.org/web/20051218202306/http://www.ocj.co.jp/english/products/infrared_f/infrared_f.htm>.*

* cited by examiner

*Primary Examiner*—David M Gray
*Assistant Examiner*—Barnabas T Fekete
(74) *Attorney, Agent, or Firm*—Turocy & Watson, LLP

(57) ABSTRACT

In a fixing device of an image forming apparatus of the present invention, inner surfaces of upper and lower frames for respectively supporting a heat roller and a pressure roller are formed as a mirror surface. Between the heat roller and an infrared temperature sensor, an infrared transmission filter for cutting infrared rays beyond a wave length zone equivalent to a heatable area of the heat roller is installed. Detection results of a surface temperature of the heat roller by the infrared temperature sensor are prevented from exceeding the error tolerance due to infrared rays radiated from other than the heat roller. Temperature control for the heat roller is improved and a fixed image of high image quality is obtained.

16 Claims, 6 Drawing Sheets

| TRANSMISSION RATE OF INFRARED RAYS (%) | DETECTION TEMPERATURE (℃) |
|---|---|
| 40 | 186.8 |
| 42 | 187.2 |
| 44 | 184.2 |
| 46 | 186.1 |
| 48 | 188 |
| 50 | 186.3 |
| 52 | 183.7 |
| 54 | 182.4 |
| 56 | 180.4 |
| 58 | 180.6 |
| 60 | 182.2 |
| 62 | 179.1 |
| 64 | 180.4 |
| 68 | 179.8 |

FIXING DEVICE AND FIXING METHOD OF IMAGE FORMING APPARATUS

BACKGROUND OF THE INVENTION

1. Field of the Invention

The present invention relates to a fixing device of an image forming apparatus such as a copier, a printer, or a facsimile which is loaded therein for heating and fixing a toner image and a fixing method for the image forming apparatus.

2. Description of the Background

As a fixing device used for an image forming apparatus such as an electro-photographic copier or a printer, there is a fixing device available for inserting a sheet of paper through a nip formed between a pair of rollers composed of a heat roller and a pressure roller or similar belts and heating, pressurizing, and fixing a toner image. In such a heating type fixing device, to keep the heat roller at a constant fixable temperature, the surface temperature of the heat roller is detected by a temperature sensor and a heating source is controlled so as to be turned on or off according to detection results.

As a temperature sensor, in recent years, as an infrared temperature sensor, a non-contact temperature sensor for detecting temperature without making contact with non-heated members of the heat roller and fixing belt is used. A non-contact infrared temperature sensor using a thermopile does not damage the surfaces of the heated members and can lengthen the life span of the heat roller.

However, when such a non-contact infrared temperature sensor is used, not only infrared rays emitted from the surfaces of the heated members but also infrared rays radiated from other than the surfaces of the heated members enter the conventional infrared temperature sensor by irregular reflection. Therefore, there is a risk that the infrared temperature sensor may detect the temperatures of the heated members as temperatures different from the actual temperatures.

Therefore, in a fixing device for detecting the surface temperatures of the heated members by the non-contact infrared temperature sensor, development of a fixing device of an image forming apparatus for preventing an incorrect detection of temperature caused by irregular reflection and incidence of infrared rays other than the infrared rays radiated from the heated members, thereby detecting the temperatures of the heated members with high precision, controlling exactly the temperatures of the heated members, improving the fixing property of the heated members, and obtaining a high image quality is desired.

SUMMARY OF THE INVENTION

An object of the embodiments of the present invention, in a fixing device for detecting the surface temperatures of heated members by a non-contact infrared temperature sensor, is to prevent infrared rays other than infrared rays radiated from the heated members from entering a temperature sensor. By doing this, the temperature sensor is not influenced by infrared-ray energy radiated from other than the heated members and detects the surface temperatures of the heated members with high precision. As a result, on the basis of the highly precise detection results, the temperature sensor controls the temperatures of the heated members with high precision, thus a high image quality due to a satisfactory fixing property is obtained.

According to the embodiments of the present invention, there is provided a fixing device of an image forming apparatus comprising a heated member to make contact with a fixed medium and fix a toner image on the fixed medium; a heat source member to heat the heated member; a non-contact temperature detection member to detect a surface temperature of the heated member; and a prevention member provided between the heat source member and the temperature detection member to prevent infrared rays from other than the heated member from entering the temperature detection member.

DETAILED DESCRIPTION OF THE INVENTION

Figure 1:
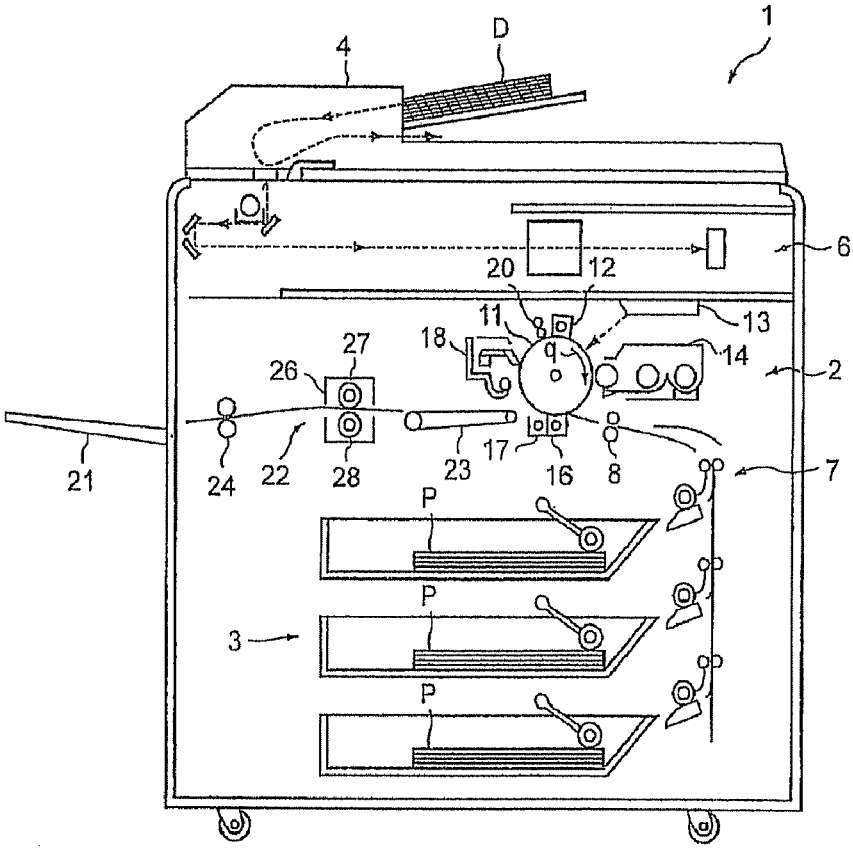
FIG. 1 is a schematic block diagram showing the image forming apparatus of the first embodiment of the present invention.

The embodiments of the present invention will be explained below in detail with reference to the accompanying drawings. FIG. 1 is a schematic block diagram showing an image forming apparatus 1 having a loaded fixing device 26 of the embodiments of the present invention. The image forming apparatus 1 includes a cassette mechanism 3 for supplying a sheet P which is a fixed medium to an image forming unit 2 and a scanner unit 6 on the top for reading a document D supplied by an automatic document feeder 4. On a conveying path 7 from the cassette mechanism 3 to the image forming unit 2, aligning rollers 8 are installed.

The image forming unit 2, around a photosensitive drum 11, includes a main charger 12 for uniformly charging the photosensitive drum 11 sequentially in the rotational direction of an arrow q of the photosensitive drum 11, a laser exposure device 13 for forming a latent image on the charged photosensitive drum 11 on the basis of image data from the scanner unit 6, a developing device 14, a transfer charger 16, a separation charger 17, a cleaner 18, and a discharging LED 20. The image forming unit 2 forms a toner image on the photosensitive drum 11 by an image forming process by the well-known electro-photographic method and transfers it to the sheet P.

On the down stream side of the image forming unit 2 in the conveying direction of the sheet P, a sheet ejection conveying path 22 for conveying the sheet P with the toner image transferred to toward a sheet ejection unit 21 is installed. On the sheet ejection conveying path 22, a conveying belt 23 for conveying the sheet P separated from the photosensitive drum 11 to the fixing device 26 and ejection rollers 24 for ejecting the sheet P passing the fixing device 26 to the sheet ejection unit 21 are installed.

Figure 2:
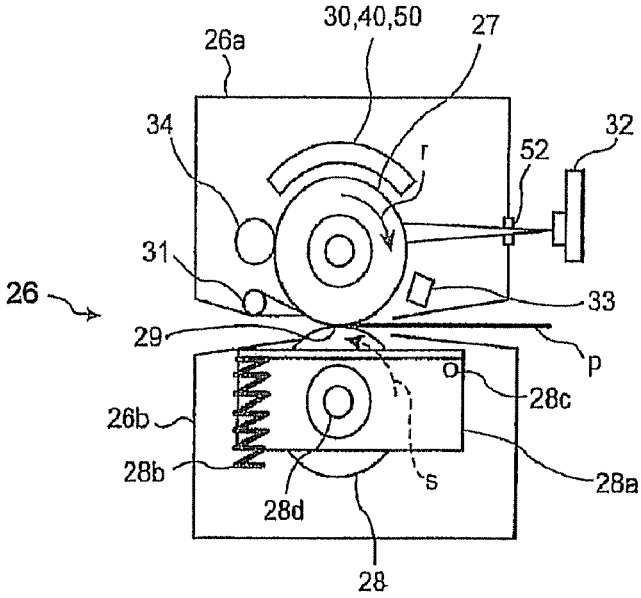
FIG. 2 is a schematic block diagram of the fixing device of the first embodiment of the present invention viewed in the axial direction of the heat roller.
Figure 3:
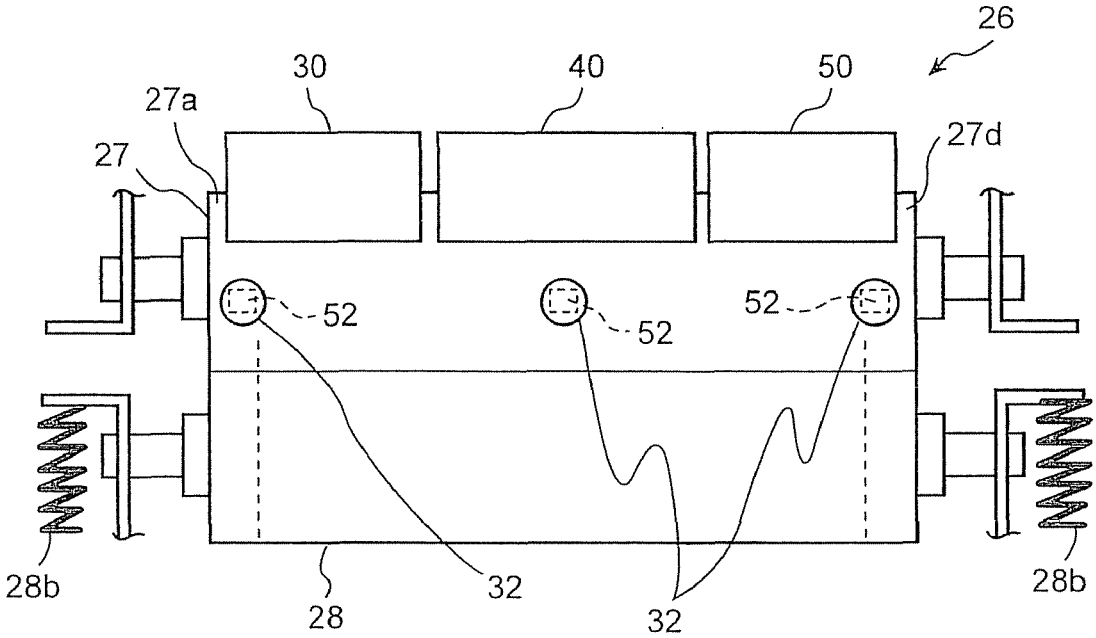
FIG. 3 is a schematic layout of the fixing device of the first embodiment of the present invention viewed in the perpendicular direction to the shaft of the heat roller.
Figure 4:
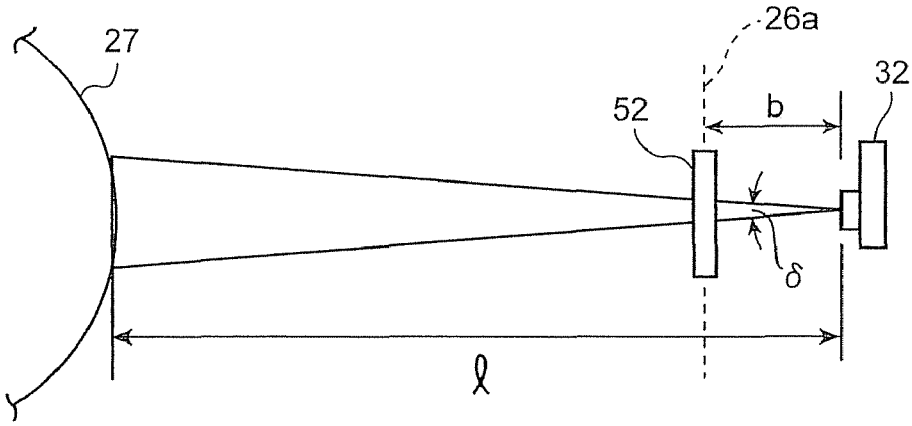
FIG. 4 is a schematic illustration showing the infrared transmission filter of the first embodiment of the present invention.

Next, the fixing device 26 will be described. FIG. 2 is a schematic block diagram of the fixing device 26 viewed in the axial direction of a heat roller 27, and FIG. 3 is a schematic layout of the fixing device 26 viewed in the perpendicular direction to the shaft of the heat roller 27, and FIG. 4 is a schematic illustration for an infrared temperature sensor 32 and an infrared transmission filter 52. The fixing device 26 of this embodiment, to control the temperature of the heat roller 27 with high precision at high speed, uses the infrared temperature sensor 32.

In this embodiment, the inner surfaces of an upper frame 26*a* and a lower frame 26*b* which are support frames of the fixing device 26 are made of stainless steel having roughness of Ra 12.5 μm (ISO and JIS standard) of the surface which is a mirror surface. The inner surfaces of the upper and lower frames 26*a* and 26*b* are formed as a mirror surface like this, so that radiation of infrared-ray energy from the upper and lower frames 26*a* and 26*b* is prevented. When the material of the upper and lower frames 26*a* and 26*b* is changed, compared with the comparative example made of stainless steel with a thickness of 20 μm having surface roughness of Ra 25 μm indicated by a solid line in FIG. 7, in the upper and lower frames 26*a* and 26*b* of this embodiment indicated by a dotted line in FIG. 7 having a mirror surface with surface roughness of Ra 12.5 μm made of stainless steel with a thickness of 80 μm, the infrared radiation rate can be lowered.

The upper and lower frames 26*a* and 26*b* of the fixing device 26 respectively support a heat roller 27 and a pressure roller 28 which are heated members. The heat roller 27 rotating in the direction of an arrow of r and the pressure roller 28 which makes contact with the heat roller 27 and rotates in the direction of an arrow s compose a fixing roller pair.

The heat roller 27 has a metallic conductive layer around the core bar via foamed rubber. The pressure roller 28 has a core bar which is covered with a surface layer such as silicone rubber or fluororubber. The pressure rubber 28, via a pressure arm 28*a* rotating around a support point 28*c*, pushes up a shaft 28*d* toward the heat roller 27 by a pressure spring 28*b*. By doing this, the pressure roller 28 is pressed to the heat roller 27, thus between the heat roller 27 and the pressure roller 28, a nip 29 with a fixed width is formed.

On the outer periphery of the heat roller 27, inductive heating coils 30, 40, and 50 which are heating source members for a 100 V power source to heat the heat roller 27 are installed via a gap of about 1.5 mm. The inductive heating coils 30, 40 and 50 are in an almost coaxial shape with the heat roller 27.

The inductive heating coils 30, 40 and 50, when drive currents are supplied respectively, generate magnetic fields. By the magnetic fields, an eddy current is generated in the metallic conductive layer (not drawn) of the surface of the heat roller 27, thus the heat roller 27 is heated. The inductive heating coils 30, 40, and 50 are divided and arranged in the longitudinal direction of the heat roller 27 and heat respectively the opposite areas of the heat roller 27. The inductive heating coils 30, 40 and 50 are respectively controlled for the power value according to the frequencies of the drive currents, and by the power values of the inductive heating coils 30, 40 and 50, the heat value of the metallic conductive layer of the heat roller 27 is changed, thus the heat roller 27 is controlled for the temperature.

Furthermore, on the outer periphery of the heat roller 27, in the rotational direction of the arrow r of the heat roller, a thermistor 33 for detecting an error in the surface temperature of the heat roller 27 and interrupting heating, a separation pawl 31 for preventing the sheet P after fixing from winding round, and a cleaning roller 34 are installed. The thermistor 33 makes contact with the non-image forming areas at both ends of the heat roller 27 and detects the temperature of the heat roller 27.

In the neighborhood of the upper frame 26*a*, the infrared temperature sensor 32 for detecting the temperature of the heat roller 27 in non-contact is installed. The infrared temperature sensor 32 is arranged in each corresponding area to the respective inductive heating coils 30, 40 and 50. The infrared temperature sensors 32 detect the surface temperatures of the heat roller 27 between the inductive heating coils 30, 40 and 50 and the nip 29 formed between the heat roller 27 and the pressure roller 28.

Figure 5:
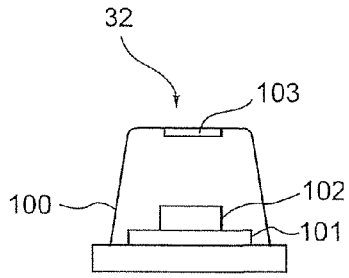
FIG. 5 is a schematic illustration showing the infrared temperature sensor of the first embodiment of the present invention.

Each of the infrared temperature sensors 32, as shown in FIG. 5, has a thermopile 102 composed of many thin film thermocouples made of polysilicone and aluminum connected in series on a heat resistant silicone substrate 101 installed in a housing 100. The housing 100 has a silicone lens 103 and focuses infrared rays from the heat roller 27 to the thermopile 102. The infrared temperature sensors 32 of the thermopile type receive infrared rays, calculate the infrared-ray energy, and detect temperature change in the hot contact portion generated in the thermopile 102 as starting power of the thermocouple.

Between the heat roller 27 and the infrared temperature sensors 32, infrared transmission filters 52 with an infrared-ray transmission rate of 53% which are a prevention member is installed. The infrared transmission filters 52 prevent maldetection of the temperature of the heat roller 27 caused by incidence of infrared rays from the portions other than the heat roller 27 to the infrared temperature sensors 32 of the non-contact type. The infrared transmission filters 52 are attached to the side of the upper frame 26*a*. Each of the infrared transmission filters 52 is obtained by forming an optical multilayer film by vacuum vapor deposition on a heat resistant glass substrate with a thickness of 1 mm and an infrared-ray transmission rate of 53% (a blue substrate and a white substrate included). The optical multilayer film, when the surface temperature of the heat roller 27 is detected, prevents infrared rays radiated from other than the heat roller 27 from entering the infrared temperature sensors 32. Therefore, an incorrect detection of the infrared temperature sensors 32 is prevented.

Here, the principle of the infrared transmission filters 52 will be described. For example, when the temperature of the heat roller 27 of the fixing device 26 is 180° C., the detection results of the infrared temperature sensors 32 are 180° C. theoretically. However, inside the fixing device 26, when the temperature of the heat roller 27 is 180° C., the insides of the frames 26*a* and 26*b* therearound are also heated to about 70 to 80° C. A contact-type sensor such as a thermistor, even in such a state, can detect that the temperature of the heat roller 27 is 180° C.

Figure 6:
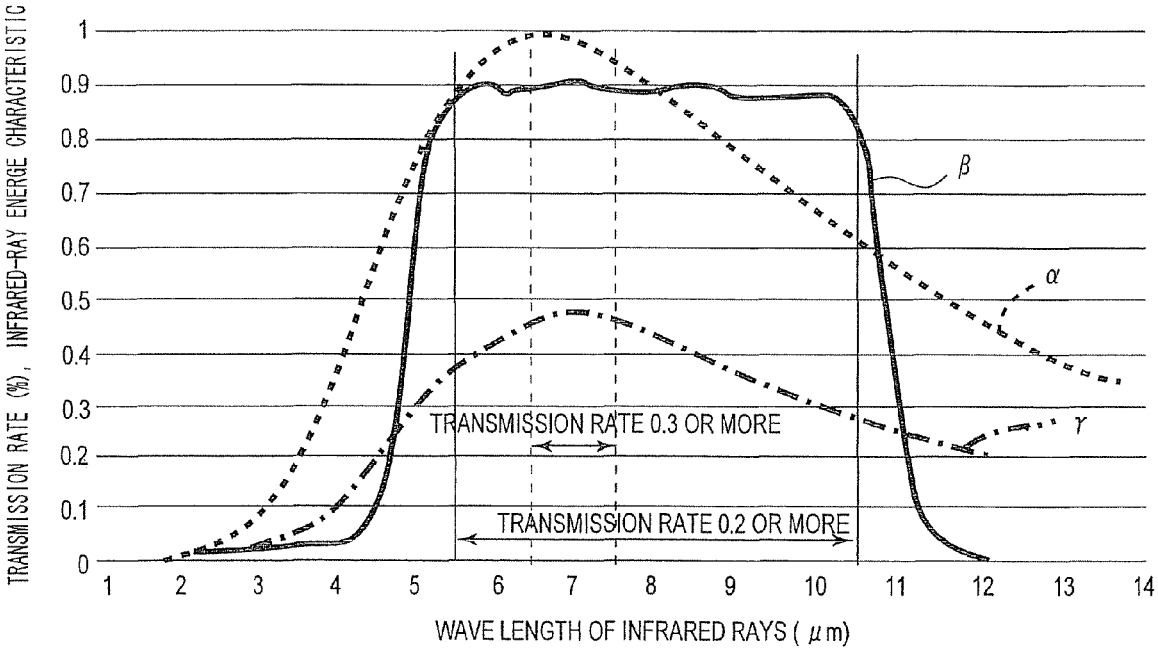
FIG. 6 is graphs showing the wave length range of the infrared transmission filter of the first embodiment of the present invention.

However, the non-contact type infrared temperature sensors 32, when measuring the temperature of the heat roller 27 free of a filter in such a state, detect 185 to 186° C. higher than the actual temperature. Therefore, the detection results by the infrared temperature sensors 32 free of a filter exceed the error tolerance (for example, when the temperature of the heat roller 27 is 180° C., 180±2 to 3° C. is within the error tolerance) when controlling the temperature of the heat roller 27. Therefore, a filter varying in the transmission rate with the wave length range is used and the temperature detection test of the heat roller 27 was executed by the infrared temperature sensors 32. As a result, it is ascertained that the infrared transmission filters 52 shown in FIG. 6 having a transmission rate of about 0.2 (20%) or more in the whole zone within the wave length range from 5.5 μm to 10.6 μm almost corresponding to the temperature range from 0° C. to 250° C. of the heat roller 27 are used, and if the transmission rate in the wave length zones from 5.5 μm to 6.5 μm and from 7.5 μm to 10.6 μm is about 0.2 (20%) or more, and the transmission rate in the wave length zone from 6.5 μm to 7.5 μm is about 0.3 (30%) or more, and the transmission rate in the other wave length ranges is 0.1 (10%) or less, the detection results of the infrared temperature sensors 32 are within the error tolerance. In FIG. 6, a dotted line ∂ indicates an infrared-ray energy distribution of the heat roller 27 heated to 180° C., and a solid line β indicates transmission characteristics of the infrared transmission filters 52, and an alternate long and short dash line γ indicates transmission characteristics of the infrared transmission filter of the comparative example.

Figures 7, 8:
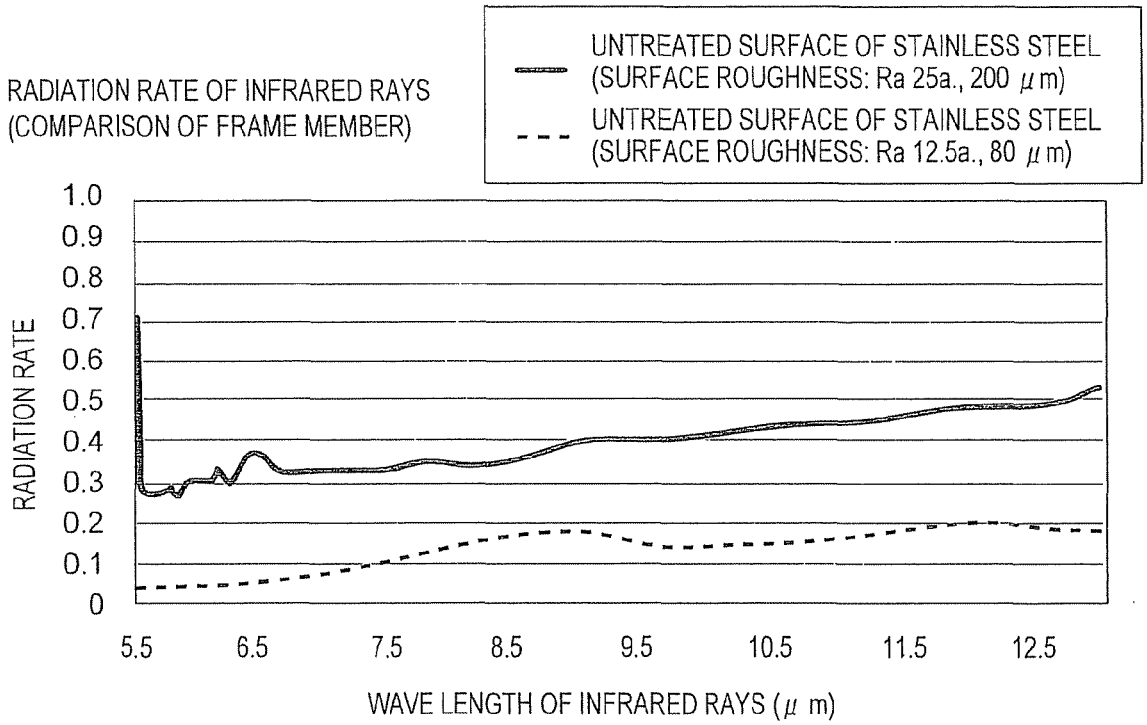
FIG. 7 is graphs showing comparison of the radiation rate of infrared rays of the upper and lower frames with a comparative example of the first embodiment of the present invention.
FIG. 8 is a table showing the relationship between the transmission rate of infrared rays of the infrared transmission filter and the detection temperature by the infrared sensor of the first embodiment of the present invention.
Figure 9:
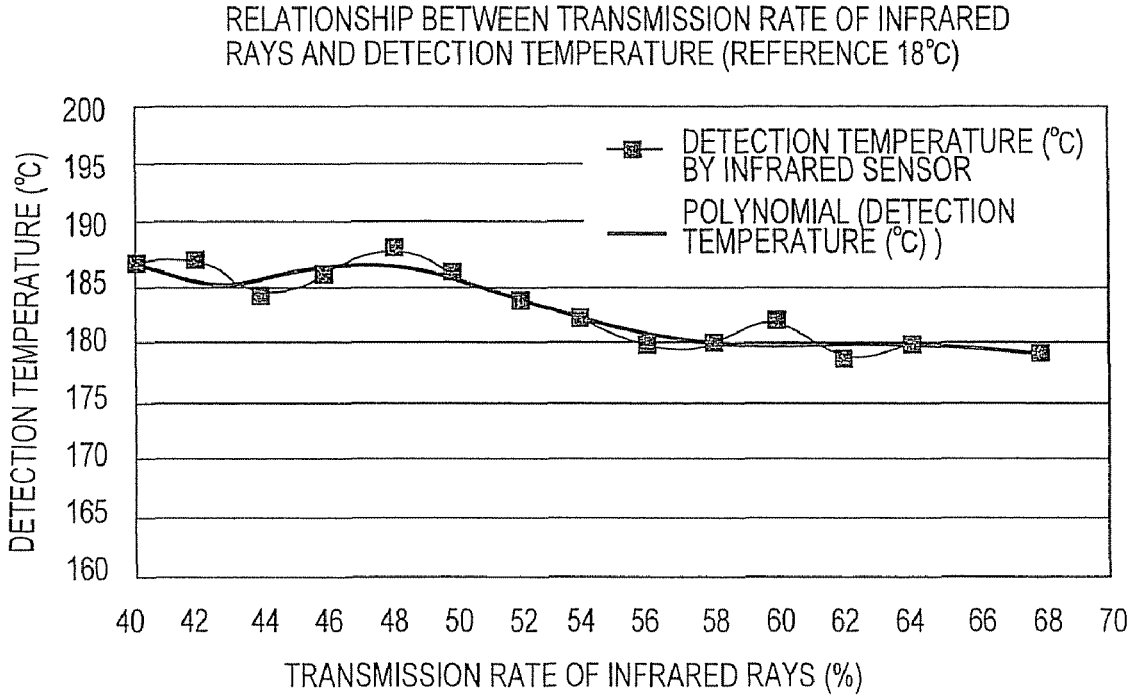
FIG. 9 is graphs showing the relationship between the transmission rate of infrared rays of the infrared transmission filter and the detection temperature by the infrared sensor of the first embodiment of the present invention.

However, in the infrared transmission filters 52, the infrared transmission rate thereof influences the detection results of the infrared temperature sensors 32. Therefore, the infrared transmission rate of the infrared transmission filters 52 within the wave length range from 5.5 μm to 10.6 μm is changed and the temperature detection test of the heat roller 27 was executed by the infrared temperature sensors 32. As a result, as shown in FIGS. 8 and 9, it is ascertained that when the infrared transmission rate of the infrared transmission filters 52 is 45% or more, the detection temperature by the infrared temperature sensors 32, for the detection temperature by a polynomial, is almost within the error tolerance.

Therefore, in this embodiment, the infrared transmission filters 52 shown in FIG. 6 in which the transmission rate in the whole zone within the wave length range from 5.5 μm to 10.6 μm is about 0.2 or more, and the transmission rate in the wave length zones from 5.5 μm to 6.5 μm and from 7.5 μm to 10.6 μm is about 0.2 (20%) or more, and the transmission rate in the wave length zone from 6.5 μm to 7.5 μm is about 0.3 (30%) or more, and the transmission rate in the other wave length ranges is 0.1 (10%) or less is used. Further, with respect to the infrared transmission filters 52, instead of cutting or transmitting various wave lengths by one filter, it is possible to overlap a plurality of infrared transmission filters having different transmission wave length zones and obtain a desired infrared transmission zone.

To attach the infrared transmission filters 52 to the upper frame 26*a*, a mold member including white and colorless glasses is used. The mold member may not include glasses. The size of the infrared transmission filters 52 is set according to a light focusing angle δ of the silicone lens 103 of the infrared temperature sensor 32 shown in FIG. 4, a distance b from the infrared temperature sensor 32 to the infrared transmission filter 52, and a distance I from the infrared temperature sensor 32 to the heat roller 27. For example, when the light focusing angle δ of the infrared temperature sensor 32 is 8°, and the distance b is 15 mm, and the distance I is 40 mm, the size of the infrared transmission filters 52 is set to 11 mm×11 mm or more.

When the size of the infrared transmission filters 52 is set like this, the infrared temperature sensors 32 are projected to the periphery of the infrared transmission filters 52, thus there is no risk that the temperature of the side wall of the upper frame 26*a* may be detected.

Further, in this embodiment, the inner surfaces of the upper and lower frames 26*a* and 26*b* of the fixing device 26 are formed so as to be a mirror surface, thus the infrared-ray energy radiated from other than the heat roller 27 is reduced by the fixing device 26.

Next, the operation of the invention will be described. When the power source of the image forming apparatus 1 is turned on, a drive current is given to the inductive heating coils 30, 40 and 50 and the heat roller 27 is warmed up in the whole area in the scanning direction which is the axial direction of the heat roller 27. The surface temperature of the heat roller 27 is detected by the infrared temperature sensors 32 and thermistor 33. From the detection results by the infrared temperature sensors 32, when the heat roller 27 reaches 180° C. and enters the ready state, according to the detection results of the infrared temperature sensors 32 and thermistor 33, the output power of the inductive heating coils 30, 40, and 50 are controlled so as to keep the ready temperature.

Into the infrared temperature sensors 32, via the infrared transmission filters 52 of the transmission characteristic indicated by the solid line β shown in FIG. 6, the infrared-ray energy from the heat roller 27 enters. Further, at this time, the inner surfaces of the upper and lower frames 26*a* and 26*b* are mirror surfaces, so that during detection of the temperature of the heat roller 27, no infrared-ray energy is radiated from the inner surfaces of the upper and lower frames 26*a* and 26*b*. Namely, to the infrared temperature sensors 32, infrared rays having an energy distribution in which the wave length zone not influencing temperature detection is cut enters. Therefore, the temperature of the heat roller 27 detected by the infrared temperature sensors 32 is within the error tolerance.

When the surface temperature of the heat roller 27 reaches the ready state from the detection results of the infrared temperature sensors 32, by an instruction of the printing operation, the image forming process is started. In the image forming unit 2, the photosensitive drum 11 rotating in the direction of the arrow q is uniformly charged by the main charger 12, and a laser beam according to the document information is radiated by the laser exposure device 13, and an electrostatic latent image is formed. Next, the electrostatic latent image is developed by the developing device 14 and a toner image is formed on the photosensitive drum 11.

The toner image on the photosensitive drum 11 is transferred to the sheet P by the transfer charger 16. Next, the sheet P is separated from the photosensitive drum 11 and reaches the fixing device 26. The sheet P conveyed to the fixing device 26 is heated to, for example, 160° C. which is a fixable temperature and is inserted through the nip 29 between the heat roller 27 rotating in the direction of the arrow r and the pressure roller 28 rotating in the direction of the arrow s, thus the toner image is heated, pressurized, and fixed.

During fixing of the toner image, the fixing device 26 detects the surface temperature of the heat roller 27 by the infrared temperature sensors 32 and thermistor 33. Also during this period, similarly to the period of warming up, the infrared temperature sensors 32 detect the surface temperature of the heat roller 27 via the infrared transmission filters 52. According to the detection results, the supply power of the induced heating coils 30, 40 and 50 is adjusted. By doing this, the surface temperature of the heat roller 27 can be controlled with high precision so as to be kept at 180° C.±10° C. and the toner image can be fixed satisfactorily onto the sheet P.

Further, when the thermistor 33 detects an error, it immediately turns off the supply power of the inductive heating coils 30, 40, and 50. When the predetermined image forming process is finished, according to the detection results of the surface temperature of the heat roller 27 by the infrared temperature sensors 32, the thermistor 33 controls the output power of the inductive heating coils 30, 40, and 50 and keeps the heat roller 27 in the ready state.

According to this embodiment, the infrared transmission filters 52 are installed between the heat roller 27 and the infrared temperature sensors 32 and the wave lengths other than the zone equivalent to 0° C. to 250° C. are cut. By doing this, infrared rays radiated from other than the heat roller 27 are prevented from entering the infrared temperature sensors 32. Therefore, the detection results by the infrared temperature sensors 32 can be controlled within the error tolerance of temperature control and the surface temperature of the heat roller 27 can be detected with high precision. As a result, the supply power of the inductive heating coils 30, 40 and 50 is adjusted with high precision, thus the temperature of the heat roller 27 can be controlled with high precision and the image quality can be improved by the satisfactory fixing property. Furthermore, the inner surfaces of the upper and lower frames 26*a* and 26*b* are formed as a mirror surface, thus the radiation of the infrared-ray energy from the upper and lower frames 26*a* and 26*b* is prevented. By doing this, the infrared-ray energy entered to the infrared temperature sensors 32 from other than the heat roller 27 can be reduced.

Next, the second embodiment of the present invention will be explained. In the second embodiment, unlike the first embodiment, in place of the infrared transmission filters, the space between the heat roller 27 and the infrared temperature sensors 32 is covered with a duct. Therefore, in the second embodiment, to the same components as those explained in the first embodiment, the same numerals are assigned and the detailed explanation thereof will be omitted.

Figure 10:
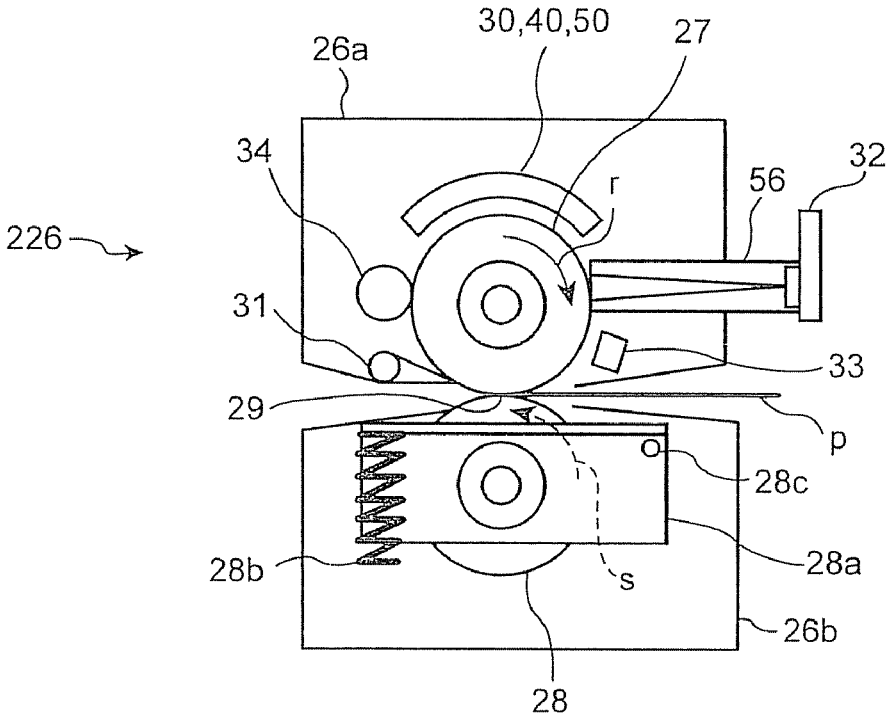
FIG. 10 is a schematic block diagram of the fixing device of the second embodiment of the present invention viewed in the axial direction of the heat roller.
Figure 11:
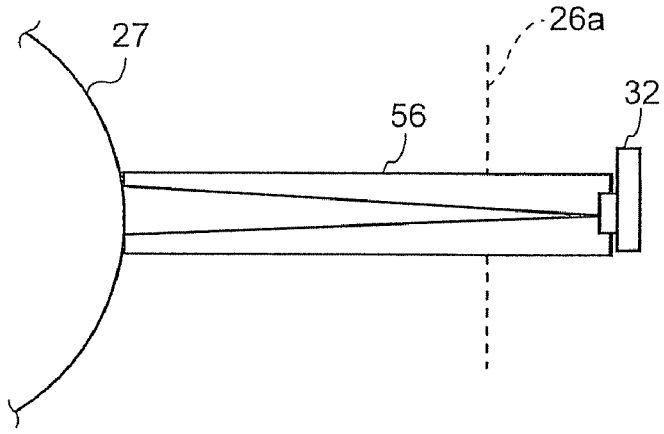
FIG. 11 is a schematic illustration showing the duct of the second embodiment of the present invention.

In a fixing device 226 in this embodiment, infrared rays radiated from the areas other than the heat roller 27 is prevented from entering the infrared temperature sensors 32 and the surface temperature of the heat roller 27 is detected with high precision by the infrared temperature sensors 32. Therefore, in this embodiment, as shown in FIGS. 10 and 11, a duct 56 which is a prevention member is installed between the heat roller 27 and the infrared temperature sensors 32. The inner surface of the duct 56 is composed of stainless steel having a mirror surface with a surface roughness Ra of 12.5a μm. The thickness of stainless steel is 80 μm. The outer periphery of the stainless steel is covered with a heat-resistant resin or a heat insulating member.

The duct 56 leads the infrared-ray energy radiated from the surface of the heat roller 27 directly to the infrared temperature sensors 32. Further, the duct 56 prevents infrared-ray energy radiated and reflected irregularly from other than the heat roller 27 in the fixing device 226 from entering the infrared temperature sensors 32. When the heat roller 27 is in operation, the duct 56 close to the heat roller 27 raises the temperature. However, the inner surface of the duct 56 is a mirror surface, so that no infrared rays are radiated from the surface of the duct 56. Therefore, the infrared temperature sensors 32 are not influenced by radiation in the area unnecessary for temperature control of the heat roller 27 and can detect only the surface temperature of the heat controller 27 with high precision.

According to this embodiment, similarly to the first embodiment, the inner surfaces of the upper and lower frames 26*a* and 26*b* are mirror surfaces and radiation of infrared rays from the upper and lower frames 26*a* and 26*b* is prevented. Further, between the heat roller 27 and the infrared temperature sensors 32, the duct 56 having the inner surface of a mirror surface is installed and into the infrared temperature sensors 32, only the infrared-ray energy radiated from the surface of the heat roller 27 enters. Therefore, the infrared temperature sensors 32, similarly to the first embodiment, free of an incorrect detection of temperature caused by detection of infrared-ray energy radiated and reflected irregularly from other than the heat roller 27, can detect the surface temperature of the heat roller 27 with high precision. As a result, the temperature of the heat roller 27 can be controlled with high precision and the image quality can be improved by the satisfactory fixing property.

Further, the present invention is not limited to the embodiments aforementioned and can be changed variously within the scope of the present invention. For example, the kind of the non-contact temperature detection member and response time are not restricted. Further, with respect to the mirror surface, if it does not radiate infrared rays, the material and surface roughness thereof are not restricted. Furthermore, in the first embodiment, the size of the infrared transmission filters and the thickness thereof are not restricted. Further, the material of the substrates of the infrared transmission filters is also optional and for example, in place of the heat-resistant glass substrate, if a heat-resistant silicone substrate is used, the transmission rate of infrared rays can be improved much more. Further, the structure and material of the duct of the second embodiment are not restricted and ABS resin or PPS resin used for the mirror-finished inner surface of the duct is acceptable. Furthermore, the heating source is not limited to the inductive heating coil, that is, a heater may be used to heat and the inductive heating coil may be installed inside the heated member.

What is claimed is:

1. A fixing device of an image forming apparatus comprising:

a heated member configured to contact with a fixed medium and fix a toner image on the fixed medium;

a heating source member configured to heat the heated member;

a frame configured to support the heated member in a main body of the image forming apparatus, the frame having a mirrored surface on an inner surface;

an infrared transmission filter attached to an opening of a side wall of the frame;

a non-contact temperature sensor to detect a surface temperature of the heated member between the heating source member and a nip of the heated member, the non-contact temperature sensor being installed outside of the frame to calculate an infrared-ray energy radiated from the heated member via the infrared transmission filter.

2. The device according to claim 1, wherein the inner surface of the frame member has a mirror surface made of stainless steel.

3. The device according to claim 1, wherein the heated member includes a heat roller having a metallic conductive layer around a core bar via a foamed rubber.

4. The device according to claim 3, wherein the heating source member is provided on an outer periphery of the heat roller in an almost coaxial shape with the heat roller.

5. The device according to claim 4, wherein the heating source member includes an inductive heating coil.

6. The device according to claim 1, wherein the heated member includes a fixing roller pair comprising a heat roller and a pressure roller.

7. The device according to claim 6, wherein the pressure roller presses to the heat roller to form a nip between the heat roller and the pressure roller.

8. The device according to claim 6, wherein the frame includes an upper frame which supports the heat roller and a lower frame which supports the pressure roller.

9. The device according to claim 1, wherein the inner surfaces of the frame has a roughness of Ra 12.5 μm made of stainless steel with a thickness of 80 μm to prevent the infrared-ray energy radiated from the inner surface of the frame.

10. The device according to claim 1, wherein the infrared transmission filter has a transmission rate of 45% or more at an infrared wavelength from 5.5 μm to 10.6 μm.

11. The device according to claim 1, wherein the infrared transmission filter cuts wavelengths other than the zone equivalent to 0° C. to 250° C.

12. The device according to claim 1, wherein the infrared transmission filter is attached to the opening where positioned upstream in the conveying direction of the fixed medium on the side wall of the frame.

13. A fixing device of an image forming apparatus comprising:

a heated member configured to contact with a fixed medium and fix a toner image on the fixed medium;

a heating source member configured to heat the heated member;

a frame configured to support the heated member in a main body of the image forming apparatus, the frame having a mirrored surface on the inner surface;

an infrared transmission filter attached to an opening of a side wall of the frame;

a non-contact temperature sensor to detect a surface temperature of the heated member between the heating source member and a nip, the non-contact temperature sensor being installed outside of the frame to calculate an infrared-ray energy radiated from the heated member via the infrared transmission filter, a size of the infrared transmission filter being set according to a light focusing angle of a silicone lens of the non-contact temperature sensor, a distance from the non-contact temperature sensor to the infrared transmission filter, and a distance from the non-contact temperature sensor to the heated member; and wherein the size of the infrared transmission filter is set as 11 mm×11 mm or more according to a light focusing angle of the non-contact temperature sensor being 8°, a distance from the non-contact temperature sensor to the infrared transmission filter being 15 mm, and a distance from the non-contact temperature sensor to the heated member being 40 mm.

14. A method for detecting a temperature of a fixing device comprising:

supporting a heated member, which is heated by a heating source member, to a frame;

providing an infrared transmission filter attached to an opening of a side wall of the frame, which varies in a transmission rate with an infrared wavelength, to the frame;

providing a mirrored surface on an inner surface of the frame to reduce the infrared-ray energy radiated from other than the heated member; and detecting a surface temperature of the heated member by a non-contact temperature detecting member being installed outside of the frame to calculate an infrared-ray energy radiated from the heated member via the transmission filter.

15. The method according to claim 14, wherein the infrared transmission filter has a transmission rate of 45% or more at an infrared wavelength from 5.5 μm to 10.6 μm.

16. The method according to claim 14, wherein the infrared transmission filter is installed between the heated member and the temperature detecting member, and the wave length other than the zone equivalent to 0° C. to 250° C. are cut.

* * * * *